US005611092A

United States Patent [19]

Van Dusen

[11] Patent Number: 5,611,092

[45] Date of Patent: Mar. 18, 1997

[54] CHILD'S TOILET WITH A DISPOSABLE LINER

[76] Inventor: Patricia Van Dusen, 2210 10A Street, Coaldale AB, Canada, TIM 1B8

[21] Appl. No.: 517,370

[22] Filed: Aug. 21, 1995

[51] Int. Cl.[6] ..... A47K 11/06

[52] U.S. Cl. ..... 4/484

[58] Field of Search ..... 4/476, 478, 483, 4/484, 485, 486, 449

[56] References Cited

U.S. PATENT DOCUMENTS

| | | | |
|---|---|---|---|
| 345,890 | 7/1886 | Farson | 4/449 X |
| 1,650,365 | 11/1927 | Kuhn | 4/483 X |
| 1,952,216 | 3/1934 | Owings | 4/478 X |
| 3,118,146 | 1/1964 | Dorey | 4/484 X |
| 3,553,742 | 1/1971 | Nordstedt et al. | 4/484 X |
| 3,683,426 | 8/1972 | Lagstrom | 4/484 |
| 3,693,193 | 9/1972 | May | 4/484 |

*Primary Examiner*—Charles E. Phillips

[57] ABSTRACT

A child's toilet with a disposable liner comprised of a main housing having a circular hole formed through a top wall thereof. The main housing has a rectangular hole formed through a front wall thereof extending into a hollow interior. The device contains a sliding bin having a circular chamber formed within a top wall thereof. The sliding bin is adapted for removable securement through the rectangular hole in the front wall of the main housing within the hollow interior thereof with the circular chamber corresponding with the circular hole formed through the top wall of the main housing. A disposable liner is adapted for removable coupling within the circular chamber of the sliding bin.

1 Claim, 3 Drawing Sheets

CHILD'S TOILET WITH A DISPOSABLE LINER

BACKGROUND OF THE INVENTION

1. Field of the Invention

The present invention relates to a child's toilet with a disposable liner and more particularly pertains to allowing a child's bowel movement to be disposed of in a sanitary manner with a child's toilet with a disposable liner.

2. Description of the Prior Art

The use of disposable liners is known in the prior art. More specifically, disposable liners heretofore devised and utilized for the purpose of disposing of human waste are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,136,798 to Oberstein discloses a flushable bedpan bag.

U.S. Pat. No. 3,546,716 to Laumann discloses a disposable bedpan liner.

U.S. Pat. No. Des. 261,429 to Hanna-Burns discloses the ornamental design for a bed pan seat liner.

U.S. Pat. No. 4,343,053 to O'Connor discloses a disposable bedpan liner.

U.S. Pat. No. 4,633,536 to Tribble-DuBose discloses a collapsible potty chair with disposable bag.

U.S. Pat. No. 4,509,215 to Paz discloses a disposable liner for a musical potty chair.

While these devices fulfill their respective, particular objective and requirements, the aforementioned patents do not describe a child's toilet with a disposable liner for allowing a child's bowel movement to be disposed of in a sanitary manner.

In this respect, the child's toilet with a disposable liner according to the present invention substantially departs from the conventional concepts and designs of the prior art, and in doing so provides an apparatus primarily developed for the purpose of allowing a child's bowel movement to be disposed of in a sanitary manner.

Therefore, it can be appreciated that there exists a continuing need for new and improved child's toilet with a disposable liner which can be used for allowing a child's bowel movement to be disposed of in a sanitary manner. In this regard, the present invention substantially fulfills this need.

SUMMARY OF THE INVENTION

In the view of the foregoing disadvantages inherent in the known types of disposable liners now present in the prior art, the present invention provides an improved child's toilet with a disposable liner. As such, the general purpose of the present invention, which will be described subsequently in greater detail, is to provide a new and improved child's toilet with a disposable liner and method which has all the advantages of the prior art and none of the disadvantages.

To attain this, the present invention essentially comprises a main housing having a generally rectangular configuration. The main housing has a hollow interior, a top wall, a bottom wall, a front wall, a back wall, and two side walls. The top wall has a circular hole formed therethrough. The front wall has a rectangular hole formed therethrough extending into the hollow interior. An interior lid is hingedly secured to a distal end of the top wall of the main housing. The interior lid has a circular hole formed therethrough corresponding with the circular hole in the top wall when the interior lid is in a closed configuration. The interior lid has contoured outer edges. An exterior lid is hingedly secured to the distal end of the top wall of the main housing. The exterior lid has a lip extending downwardly from an outer periphery thereof. The exterior lid is adapted for removably coupling over the interior lid in the closed configuration. The device contains a sliding bin having a top wall, a bottom wall, a front wall, a back wall, and two side walls. The top wall has a circular chamber formed therein. The front wall has an L-shaped handle secured thereto. The sliding bin is adapted for removable securement through the rectangular hole in the front wall of the main housing within the hollow interior thereof with the circular chamber corresponding with the circular hole formed through the top wall of the main housing. The device contains a disposable liner having an open top, a closed bottom, and expanding side walls. The disposable liner is adapted for removable coupling within the circular chamber of the sliding bin.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved child's toilet with a disposable liner which has all the advantages of the prior art disposable liners and none of the disadvantages.

It is another object of the present invention to provide a new and improved child's toilet with a disposable liner which may be easily and efficiently manufactured and marketed.

It is a further object of the present invention to provide a new and improved child's toilet with a disposable liner which is of durable and reliable construction.

An even further object of the present invention is to provide a new and improved child's toilet with a disposable liner which is susceptible of a low cost of manufacture with regard to both materials and labor, and which accordingly is then susceptible of low prices of sale to the consuming public, thereby making such a child's toilet with a disposable liner economically available to the buying public.

Still yet another object of the present invention is to provide a new and improved child's toilet with a disposable liner which provides in the apparatuses and methods of the prior art some of the advantages thereof, while simultaneously overcoming some of the disadvantages normally associated therewith.

Even still another object of the present invention is to provide a new and improved child's toilet with a disposable liner for allowing a child's bowel movement to be disposed of in a sanitary manner.

Lastly, it is an object of the present invention to provide a new and improved child's toilet with a disposable liner comprised of a main housing having a circular hole formed through a top wall thereof. The main housing has a rectangular hole formed through a front wall thereof extending into a hollow interior. The device contains a sliding bin having a circular chamber formed within a top wall thereof. The sliding bin is adapted for removable securement through the rectangular hole in the front wall of the main housing within the hollow interior thereof with the circular chamber corresponding with the circular hole formed through the top wall of the main housing. A disposable liner is adapted for removable coupling within the circular chamber of the sliding bin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
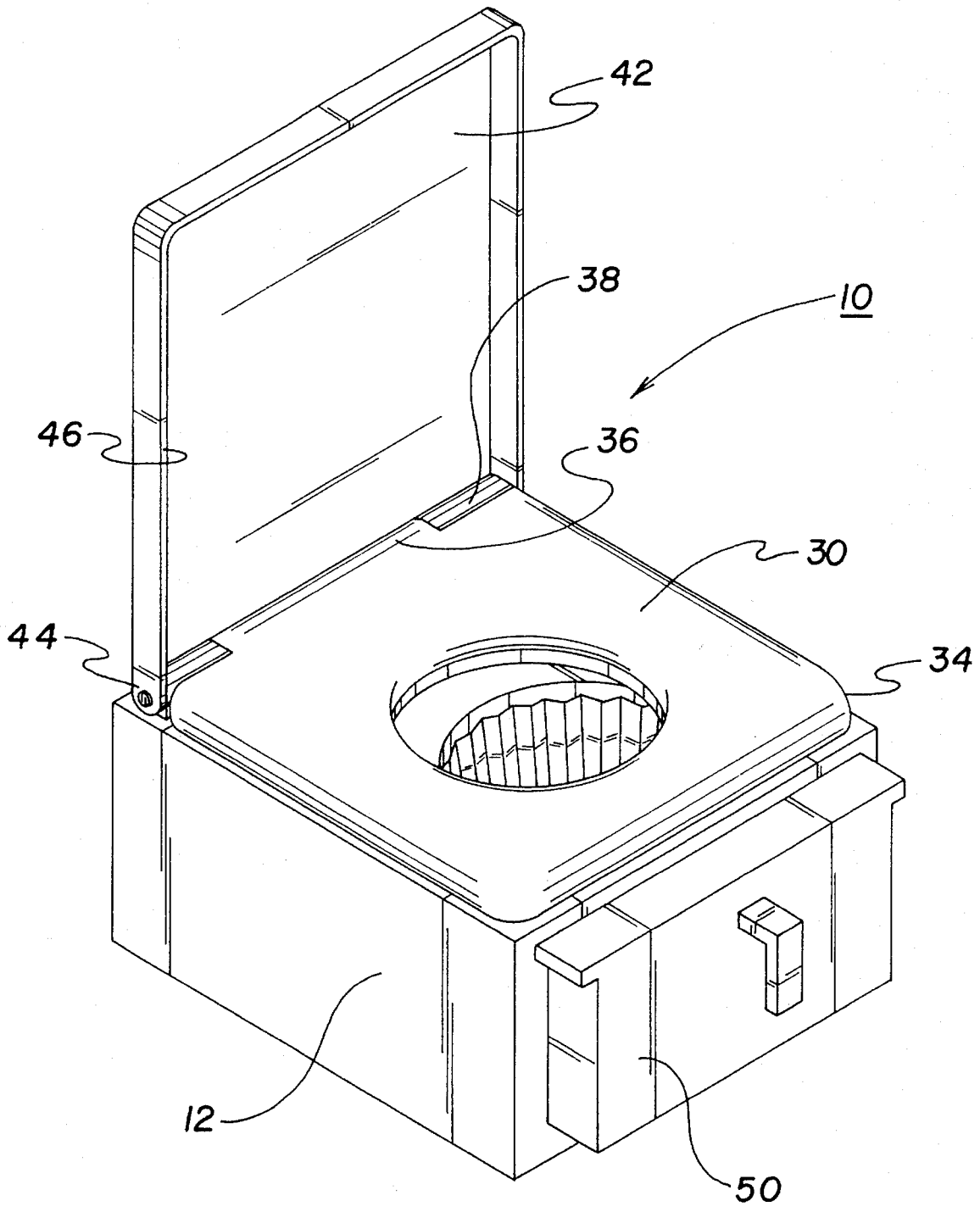
FIG. 1 is a perspective view of the preferred embodiment of the child's toilet with a disposable liner constructed in accordance with the principles of the present invention.
Figure 2:
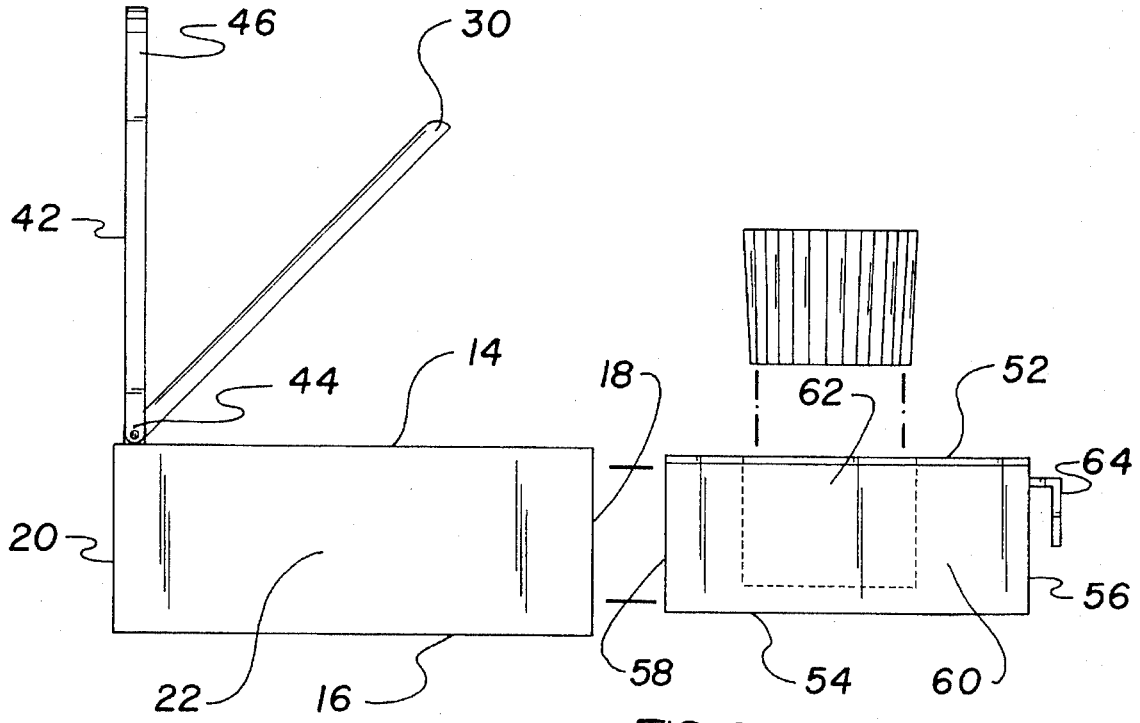
FIG. 2 is a side elevation view of the present invention.
Figure 3:
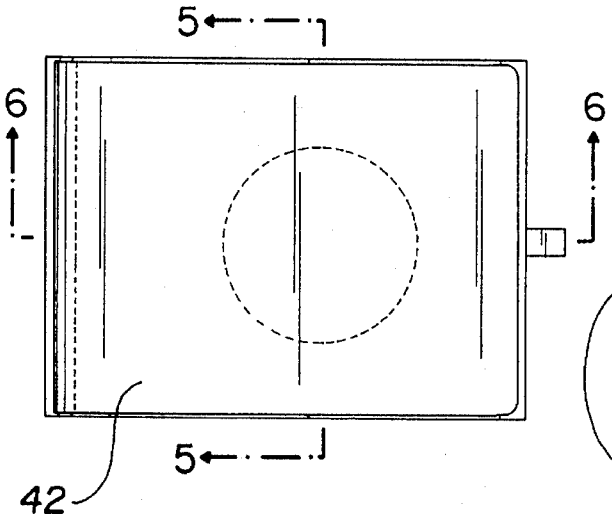
FIG. 3 is a plan view of the preferred embodiment of the present invention.
Figure 4:
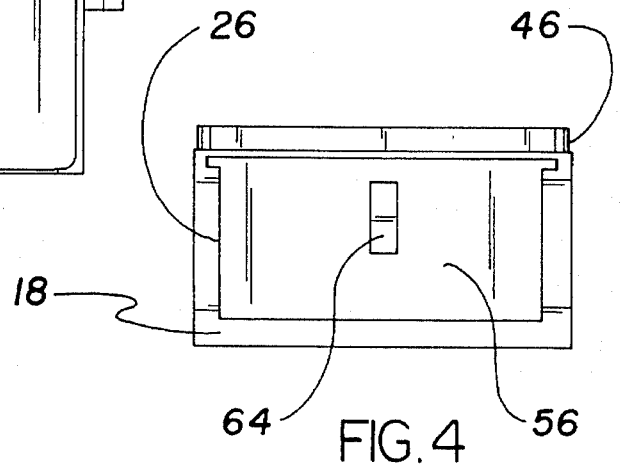
FIG. 4 is a front elevation view of the present invention.
Figure 5:
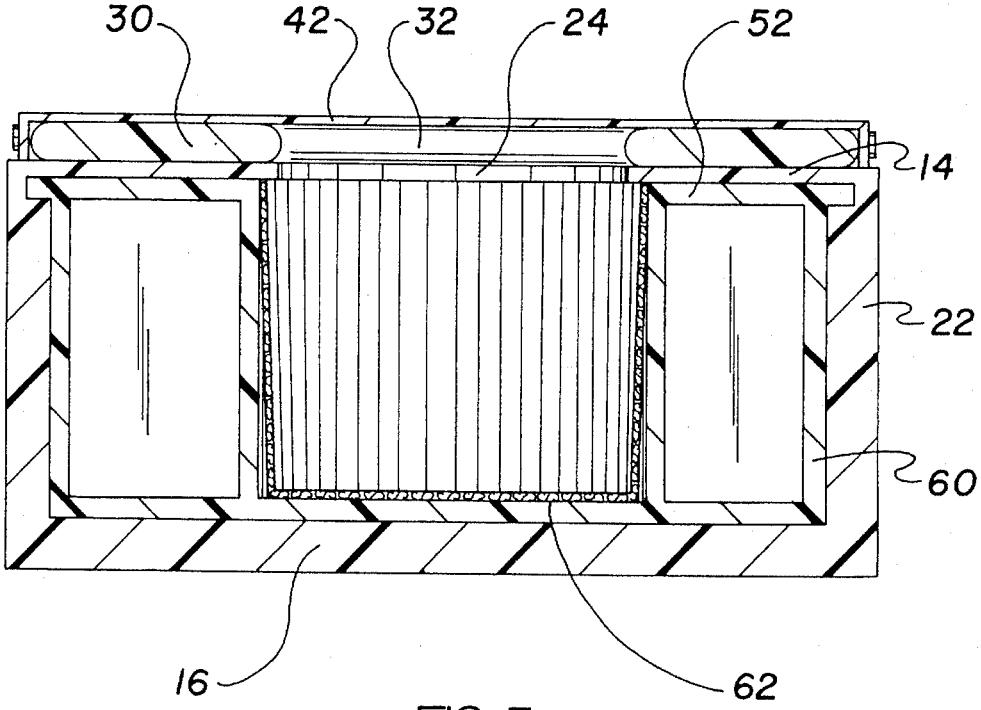
FIG. 5 is a cross-sectional view as taken along line 5—5 of FIG. 3.
Figure 6:
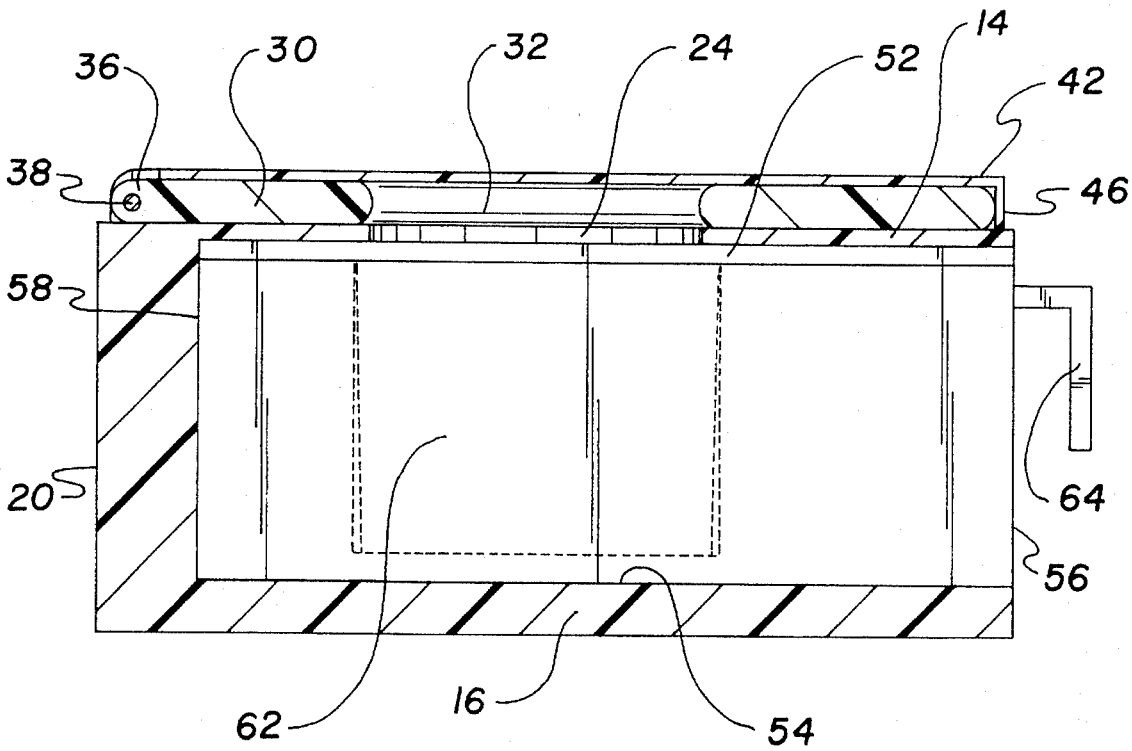
FIG. 6 is a cross-sectional view as taken along line 6—6 of FIG. 3.

With reference now to the drawings, and in particular, to FIG. 1 thereof, the preferred embodiment of the new and improved child's toilet with a disposable liner embodying the principles and concepts of the present invention and generally designated by the reference number 10 will be described.

Specifically, it will be noted in the various Figures that the device relates to a new and improved child's toilet with a disposable liner for allowing a child's bowel movement to be disposed of in a sanitary manner. In its broadest context, the device consists of a main housing, an interior lid, an exterior lid, a sliding bin, and a disposable liner. Such components are individually configured and correlated with respect to each other so as to attain the desired objective.

The first component of the device 10 is a main housing 12. The main housing 12 has a generally rectangular configuration. The main housing 12 has a hollow interior, a top wall 14, a bottom wall 16, a front wall 18, a back wall 20, and two side walls 22. The top wall 14 has a circular hole 24 formed therethrough. The front wall 18 has a rectangular hole 26 formed therethrough extending into the hollow interior. The main housing 12 is constructed of a durable molded plastic which allows for it to be handled easily and also allows for it to be easily cleaned and sanitized.

The second component of the device 10 is an interior lid 30. The interior lid 30 is hingedly secured to a distal end of the top wall 14 of the main housing 12. The interior lid 30 has a circular hole 32 formed therethrough corresponding with the circular hole 24 in the top wall 14 when the interior lid 30 is in a closed configuration. The interior lid 30 has contoured outer edges 34. The interior lid 30 has a hinged portion 36 extending from a distal end thereof. The hinged portion 36 is coupled with a circular rod 38 secured to the distal end of the top wall 14 of the main housing 12. The contoured outer edges 34 conform to the child's legs to provide comfort when the child is seated upon the interior lid 30. The interior lid 30 is constructed of molded plastic.

The third component of the device 10 is an exterior lid 42. The exterior lid 42 is hingedly secured to the distal end of the top wall 14 of the main housing 12. The exterior lid 42 has open end portions 44 that are adapted for securement to ends of the circular rod 38. The exterior lid 42 has a lip 46 extending downwardly from an outer periphery thereof. The exterior lid 42 is adapted for removably coupling over the interior lid 30 in the closed configuration. The exterior lid 42 is closed over the interior lid 32 thereby covering the circular hole 24 when not in use. The exterior lid 42 can be raised to a position nearly perpendicular to the main housing 12.

The fourth component of the device 10 is a sliding bin 50. The sliding bin 50 has a top wall 52, a bottom wall 54, a front wall 56, a back wall 58, and two side walls 60. The top wall 52 has a circular chamber 62 formed therein. The front wall 56 has an L-shaped handle 64 secured thereto. The sliding bin 50 is adapted for removable securement through the rectangular hole 26 in the front wall 18 of the main housing 12 within the hollow interior thereof with the circular chamber 62 corresponding with the circular hole 24 formed through the top wall 14 of the main housing 12. The circular chamber 62 is adapted to collect any liquid or solid wastes excreted by a child. Once the circular chamber 62 collects any wastes, the sliding bin 50 slides out of the main housing 12 to dispose of the waste. The sliding bin 50 is constructed of molded plastic to allow the user to easily clean out the circular chamber 62 for the next usage.

The final component of the device 10 is a disposable liner 68. The disposable liner 68 has an open top 70, a closed bottom 72, and expanding side walls 74. The disposable liner 68 is adapted for removable coupling within the circular chamber 62 of the sliding bin 50. The disposable liner 68 resembles a coffee filter. The disposable liner 68 is used to collect solid wastes excreted by the child seated upon the device 10 thereby allowing for the easy removal of the solid wastes from the device 10. The liner 68 is constructed of a material strong enough to withstand liquid permeation therethrough and still be capable of safely disposing of the soiled liner 68. The device 10 could be incorporated with a dispensing system that would provide a plurality of disposable liners 68 for the user.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A child's toilet with a disposable liner for allowing a child's bowel movement to be disposed of in a sanitary manner comprising, in combination:

a main housing having a generally rectangular configuration, the main housing having a hollow interior, a top wall, a bottom wall, a front wall, a back wall, and two side walls, the top wall having a circular hole formed therethrough, the front wall having a rectangular hole formed therethrough extending into the hollow interior;

an interior lid hingedly secured to a distal end of the top wall of the main housing, the interior lid having a circular hole formed therethrough corresponding with the circular hole in the top wall when the interior lid is in a closed configuration, the interior lid having contoured outer edges;

an exterior lid hingedly secured to the distal end of the top wall of the main housing, the exterior lid having a lip extending downwardly from an outer periphery thereof, the exterior lid adapted for removably coupling over the interior lid in the closed configuration;

a sliding bin having a top wall, a bottom wall, a front wall, a back wall, and two side walls, the top wall having a circular chamber formed therein, the front wall having an L-shaped handle secured thereto, the sliding bin adapted for removable securement through the rectangular hole in the front wall of the main housing within the hollow interior thereof with the circular chamber in vertical alignment with the circular hole formed through the top wall of the main housing and the circular hole in the interior lid;

a liquid permeable disposable liner having an open top, a closed bottom, and expanding side walls, the liquid permeable disposable liner adapted for removable coupling within the circular chamber of the sliding bin, so as to have its open top in vertical alignment with said circular holes, said liner being strong enough to withstand liquid permeation therethrough and still be capable of retaining solid waste therein.

* * * * *